US008438689B2

(12) United States Patent
Noble

(10) Patent No.: US 8,438,689 B2
(45) Date of Patent: May 14, 2013

(54) BRUSH AND BROOM BRISTLE

(75) Inventor: Edward J. Noble, Corona Del Mar, CA (US)

(73) Assignee: Noble Ideas II, Inc., Coronado, CA (US)

( * ) Notice: Subject to any disclaimer, the term of this patent is extended or adjusted under 35 U.S.C. 154(b) by 131 days.

(21) Appl. No.: 12/876,334

(22) Filed: Sep. 7, 2010

(65) Prior Publication Data

US 2012/0054975 A1 Mar. 8, 2012

(51) Int. Cl.
*A46D 1/00* (2006.01)

(52) U.S. Cl.
USPC ..... 15/207.2; 15/171; 15/105; 15/114

(58) Field of Classification Search ..... 15/DIG. 5, 15/52.1, 105, 171, 111, 114, 159.1
See application file for complete search history.

(56) References Cited

U.S. PATENT DOCUMENTS

| | | | | |
|---|---|---|---|---|
| 1,625,537 | A * | 4/1927 | Gullickson | 15/176.1 |
| 3,237,232 | A | 3/1966 | Holley | |
| 4,493,126 | A | 1/1985 | Uy | |
| 4,561,456 | A | 12/1985 | Gueret | |
| 5,778,479 | A * | 7/1998 | Raia | 15/202 |
| 6,076,221 | A | 6/2000 | Bradshaw | |
| 7,895,696 | B2 * | 3/2011 | Belmonte | 15/106 |
| 2005/0285439 | A1 | 12/2005 | Kubaitis | |
| 2006/0080799 | A1 | 4/2006 | Lucente | |

FOREIGN PATENT DOCUMENTS

| | | |
|---|---|---|
| EP | 0 079 400 A1 | 5/1983 |
| JP | 1-313005 | 12/1989 |
| JP | 3-236804 | 10/1991 |
| JP | 5-23223 | 2/1993 |
| JP | 6-57176 | 8/1994 |
| JP | 8-70933 | 3/1996 |

* cited by examiner

*Primary Examiner* — Shay Karls
(74) *Attorney, Agent, or Firm* — One llp; Kenneth S. Roberts

(57) ABSTRACT

A broom having a head part to which a first and a second plurality of bristles are coupled. The second plurality of bristles preferably comprising a hooking member positioned at an end of the bristle opposite the head part, wherein the hooking member preferably forms a cap on the second end of the body. Alternatively, a bristle device having a plurality of bristles each with a hooking member at one end, wherein the bristle device is releasably couplable to bristles or a head part of a broom. In operation, as the plurality of bristles with hooking members sweep over the debris or material to be swept along a surface, the bristle with hooking members catch, hook or hold onto the debris being swept. The row of bristles with hooking members preferably form a hooking barrier that traps the material being swept making sweeping very easy and effective.

20 Claims, 16 Drawing Sheets

BRUSH AND BROOM BRISTLE

FIELD

The present invention relates generally to brushes and brooms, and more particularly to a bristle that facilitates more efficient brushing and sweeping.

BACKGROUND

All brooms, large or small and of different shapes and designs, rely on the bristles to sweep materials. The bristles can be long or short and stiff or very flexible.

Brooms with stiff bristles are better for sweeping large, hard objects, or very thin, light objects, like leaves, while the softer bristle brooms are best for sweeping up finer materials such as dirt, sand and dust. The type of ground or floor one is sweeping on also dictates the type of broom that is best for the material to be swept.

FIG. 1A provides a schematic of a conventional broom 10 having a handle 14 attached to a broom base or head 12 and bristles 16 attached to the head 12. Regardless, all brooms, regular or push brooms, have the same basic problem when the bristles 16 meet the material 19 they are intended to sweep regardless of the surface 18; the bristles 16 bend and fold under the head 12 of the broom 10 allowing the bristles to glide or ride over the material 19 being swept. As a result, one has to sweep over the same material several times to sweep it up. Moreover, in order to compensate for the bristles gliding or riding over the material being swept, the person sweeping usually has to try to keep the broom bristles as perpendicular to the ground as much as possible in order for the bristles to have more of a bite and not glide over the material being swept in order for the sweeping to be more effective.

Another way to compensate for the bristles gliding over the material being swept is to use a broom with very stiff bristles. This has its drawbacks as brooms with stiff bristles have a hard time sweeping the finer/smaller material being swept up. The smaller/finer material necessitates the use of more concentrated finer bristles.

Attempts to improve the effectiveness of conventional brushes or brooms have included, as shown in FIG. 1B, melting the ends of all of the bristles 16 forming lumps 20 at the ends of the bristles 16. See, e.g., U.S. Published Patent Application No. 2005/0285439 A1 and Japanese Patent No. JP-403236804A. The lumps 20, however, tend to only marginally improve the sweeping effectiveness of the broom 11 with regard to large, hard objects, while tending to reduce the broom's 11 effectiveness when it comes to sweeping fine or small material. As depicted in FIG. 1B, as the bristles 16 bend and fold under the head 12 of the broom 11, the bristles 16 and lumps 20 still tend to glide or ride over the material 19 being swept, requiring the user to sweep over the same material several times to sweep it up.

Therefore, it would be desirable to provide a broom or brush with bristles that can effectively and efficiently sweep both large and fine materials at the same time while reducing the number of times one must sweep over the same material regardless of the type of ground or floor one is sweeping on.

SUMMARY

An improved broom or brush is provided that facilitates sweeping both large and fine materials at the same time while reducing the number of times one must sweep over the same material regardless of the type of ground or floor one is sweeping on. In accordance with a preferred embodiment, the broom includes a head part to which a first plurality of bristles are coupled, and a second plurality of bristles, wherein each of the second plurality of bristles comprises a body having a first end coupled to the head part and a hooking member coupled to or formed at a second end of the body. The hooking member preferably forms a cap at the second end of the body and oriented at an angle to the body sufficient to hook or catch debris during a sweeping motion.

In alternative embodiments, the hooking member comprises one or more hooks at the second end of the body, a cap formed at the end of the body and a disk slidably received over the body, a cap formed at the end of the body and other hooks positioned along the body, or a square, rectangular, or disk shaped cap formed at the end of a flat body.

In another embodiment, a broom bristle device may be provided that preferably comprises a base member removably couplable to a head of a broom with bristles attached thereto. The broom bristle device preferably includes a plurality of bristles, wherein each of the plurality of bristles comprises a body having a first end coupled to the base member and a hooking member coupled to or formed at a second end of the body. Preferably, the broom bristle device is reversibly couplable to the head of a broom.

In further embodiments, the bristle with a hooking member is incorporated in a toothbrush, a rake or a carpet sweeper brush.

In yet another embodiment, a bristle device may be provided that preferably comprises a mounting base couplable to a head of a broom with bristles attached thereto or the bristles themselves. The bristle device preferably further includes a bristle member having a base member and a plurality of bristles, wherein each of the plurality of bristles comprises a body having a first end coupled to the base member and a hooking member coupled to or formed at a second end of the body. Preferably, the base member includes a coupling member releasably couplable to the mounting base to releasably mount the bristle member on the broom.

In yet another embodiment, a bristle device kit is provided comprising a mounting base and a plurality of bristle members releasably couplable to the mounting base.

In operation, as the plurality of bristles with hooking members sweep over the debris or material to be swept along a surface, the bristle with a hooking member, like any conventional bristle, tends to lie down somewhat in the horizontal direction along the floor or surface from the pressure of the broom moving over the floor and debris. As the bristles lay down, the hooking member tends to be oriented at an angle sufficiently open to the debris to enable the hooking member to catch, hook or hold onto the debris being swept. The row of bristles with hooking members preferably form a hooking barrier that traps the material being swept making sweeping very easy and effective.

Other objects and features of the present invention will become apparent from consideration of the following description taken in conjunction with the accompanying drawings.

DESCRIPTION OF THE DRAWINGS

The details of the invention, including fabrication, structure and operation, may be gleaned in part by study of the accompanying figures, in which like reference numerals refer to like segments.

Figure 1A:
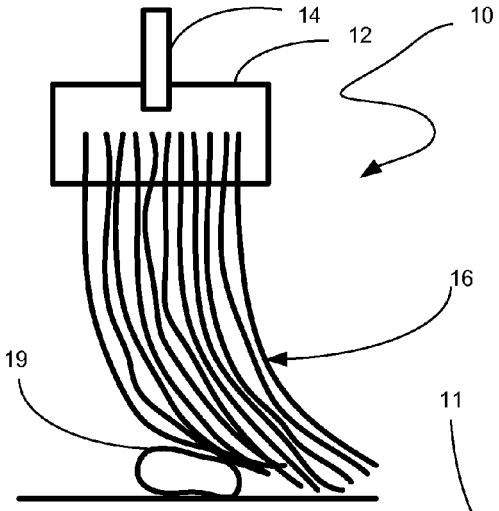
FIGURE 1A (Prior Art)
FIG. 1A is a schematic of a conventional broom shown sweeping material.
Figure 1B:
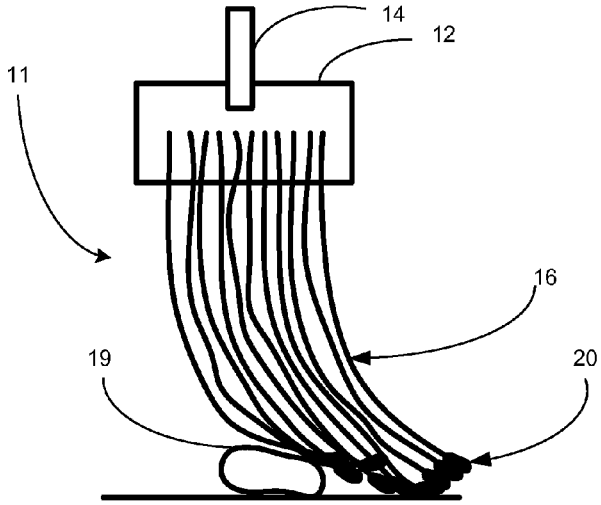
FIGURE 1B (Prior Art)
FIG. 1B is a schematic of a broom with bristles melted to form lumps at the end of the bristles.

It should be noted that the figures are not drawn to scale and that elements of similar structures or functions are generally represented by like reference numerals for illustrative purposes throughout the figures. It also should be noted that the figures are only intended to facilitate the description of the preferred embodiments.

DETAILED DESCRIPTION

Each of the additional features and teachings disclosed below can be utilized separately or in conjunction with other features and teachings to provide an improved brush or broom that facilitates sweeping both large and fine materials at the same time while reducing the number of times one must sweep over the same material regardless of the type of ground or floor one is sweeping on as described herein and in U.S. application Ser. Nos. 12/764,025, and 11/532,434, which applications are incorporated by reference. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detail description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

An improved broom 110 is provided and described in regard to FIGS. 2 through 3B and 5A through 5D. As depicted, the broom 110 preferably includes a handle 114 attached to a broom head 112, primary (aggressive) bristles 120 and secondary (passive) bristles 116 attached at a first end of the bristles to the broom head 112. The primary or aggressive bristles 120 are an improved broom bristle that facilitates sweeping due to their new and unique shape. The broom 110 effectively and efficiently sweeps large and fine materials on all types of surfaces because it incorporates flexible or soft bristles 116 with the unique shaped primary bristle 120, which provides a hooking or grabbing capability in order to sweep large and fine materials at the same time.

Figure 5A:
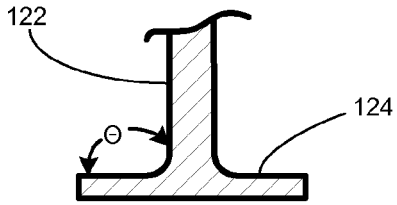
FIGS. 5A through 5E are partial cross-sectional views of embodiments of the bristle and hooking member.

The primary or aggressive bristles 120 preferably include an elongate body 122 extending beyond the length of the secondary bristles 116. The body 122 is attached at one end to the broom head 112 preferably using conventional methods. At the opposing end or sweeping end of the body 122, the bristle 120 preferably includes a hooking member in the form of a disc or cap 124 attached to the body 122. The cap 124 is preferably be oriented at any angle to the to the longitudinal axis of the body 122 of the bristle 120 that would facilitate the forming of a barrier to the material to be swept during the sweeping motion and, thus, facilitation, pulling, catching, hooking, or grabbing of the material to be swept. Preferably, the cap 124 is oriented generally perpendicular or at an angle $\theta$ of about 90° to the longitudinal axis of the body 122 as illustrated in FIG. 5A, but may be oriented at an angle $\phi$ of less 90° to the longitudinal axis of the body 122 as illustrated in FIG. 5C. One skilled in the art will readily recognize that as the angle to which the cap 124 is oriented relative to the longitudinal axis of the body 122 of the bristle 120 is too large or too small, the cap 124 will tend to less likely pull, catch, hook or grab the material to be swept. Thus, the cap 124 is preferably oriented at angle to the longitudinal axis of the body 122 of about 90° and preferably in a range of about 70° to about 110°, more preferably in a range of about 75° to about 105°, more preferably in a range of about 80° to about 110°, and more preferably in a range of about 85° to about 105°.

Figure 5B:
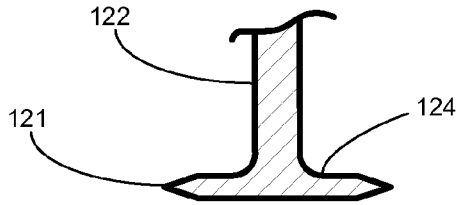
Figure 5C:
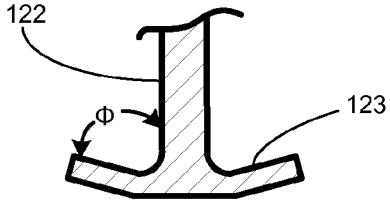
Figure 5D:
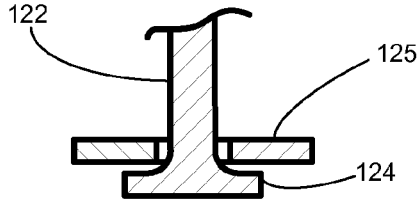

The cap or disc 124 can have a rounded or arcuate edge, a straight or flat edge as depicted in FIG. 5A, or a tapered edge 121 as depicted in FIG. 5B. The cap or disc 124 preferably has a diameter or width that is in a range of about 1.5 to 5 times (see FIGS. 5A through 5C) the diameter or width of the body 122 of the bristle 120, which can have any desired size or shape (round, oval, square, rectangular, triangular, and the like). Similarly, one of skill in the art would readily recognize that the cap or disc 124 can be any shape including circular, oval, square, rectangular, triangular, star, and the like, or simply irregularly shaped, and any size and, as one of skill in the art would readily recognize, is not dependent on the size or diameter of the body 122 of the bristle 120, i.e., the cap 124 can be several times larger than the body 122 of the bristle 120, e.g., larger than 5 times the diameter of the body, as it need not be formed by melting the bottom of the bristle. The body 122 and cap 124 of the aggressive bristles 120 can be integrally formed through injection molding techniques, extrusion and post extrusion processing techniques, and the like, or formed separately and assembled together. Additionally, as depicted in FIG. 5D, the cap 124 can be used as the stop or retainer for an additional cap or disc 125 or any additional caps made of the same material or materials other than the material the bristle 120 is made from (e.g., washers of various shapes and sizes made from materials such as metal, hard plastic and the like) that can be slidably received over the body 122 of the bristle 120.

The differences between the primary or aggressive bristle 120 and the secondary or passive bristles include the length of the primary bristle 120, which is preferably, but not necessarily, longer than the secondary bristles, and the cap or hooking member 124 at the sweep end of the body 122, which 1) acts to hook or hold on to the material 119 being swept and 2) acts as a retainer when a larger, more aggressive or larger caps 124 are attached to the sweep end of the body 122 of the bristle 120.

Figure 2:
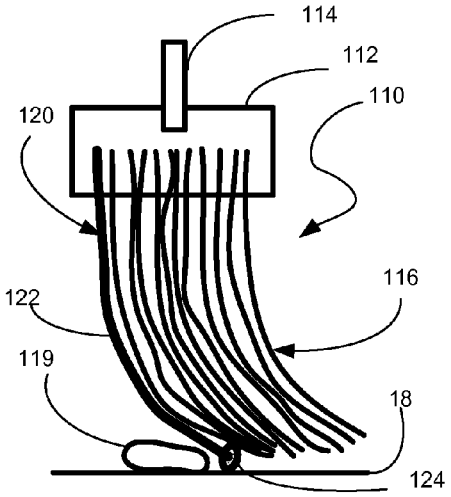
FIG. 2 is a schematic of a preferred embodiment of a broom shown sweeping material.
Figure 3A:
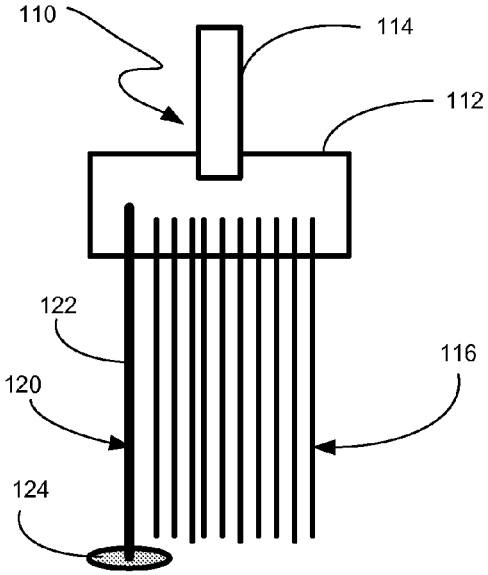
FIGS. 3A and 3B are schematic side and front views of the broom in FIG. 2.
Figure 5E:
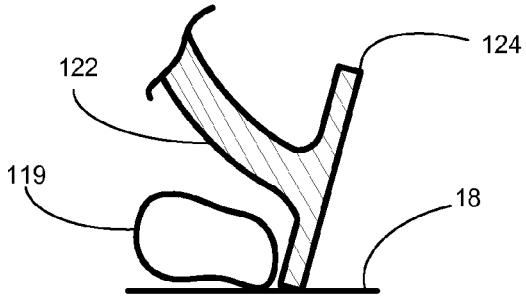

In operation, as depicted in FIGS. 2 and 5E, as the primary or aggressive bristle 120 sweeps over the debris or material 119 to be swept along the surface 118, the primary bristle 120, like any conventional bristle, tends to lie down somewhat in the horizontal direction along the floor or surface 118 from the pressure of the broom 110 moving over the floor 118 and debris 119. As the primary bristle 120 lays down, the cap 124 tends to be oriented at a angle that is sufficiently open to the debris 119 to enable the cap to catch, hook or hold on to the debris 119 being swept. The row of aggressive bristles 120 (see FIG. 3B) form a hooking barrier that traps the material being swept making sweeping very easy and effective. Conventional or regular bristles, as they sweep over debris, lay down and become parallel to the debris being swept, thus causing the bristles to ride or glide over the debris 119 leaving it behind. The aggressive bristle 120 is preferably longer than the other lighter and more passive bristles 116. As one sweeps, the bristle 120 preferably bends positioning the cap 124 at the end of the bristle 120 underneath the passive bristles 116. The passive bristles 116 tend to put pressure on the cap 124 holding the cap 124 down against the floor or ground 118 allowing it to hook, grab or catch the material 119 being swept. Thus, not only is sweeping more effective and efficient on large, small, heavy or light materials, but sweeping with the same broom is made easy on all kinds of surfaces such as rugs, street, concrete, wood flooring, stone floors (smooth or rough), grass, etc. In essence, the aggressive bristles 120 act as a rake amidst the other bristles 116.

The aggressive bristles 120 can be used in various densities in a broom along with regular broom bristles 116. The aggressive bristles can be located in a row, in a particular pattern, or in an array, or randomly located throughout the brush. As such, the aggressive bristles 120 can be implemented in any type of sweeping or brushing device.

Figure 4:
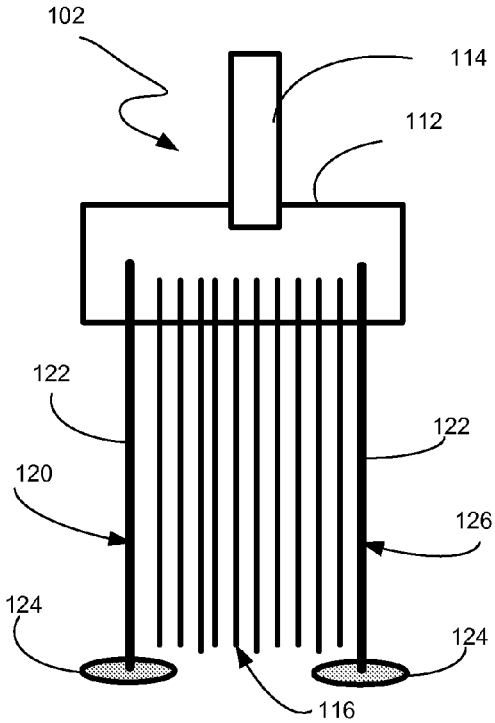
FIG. 4 is a schematic side view of an alternative embodiment of a broom.
Figure 3B:
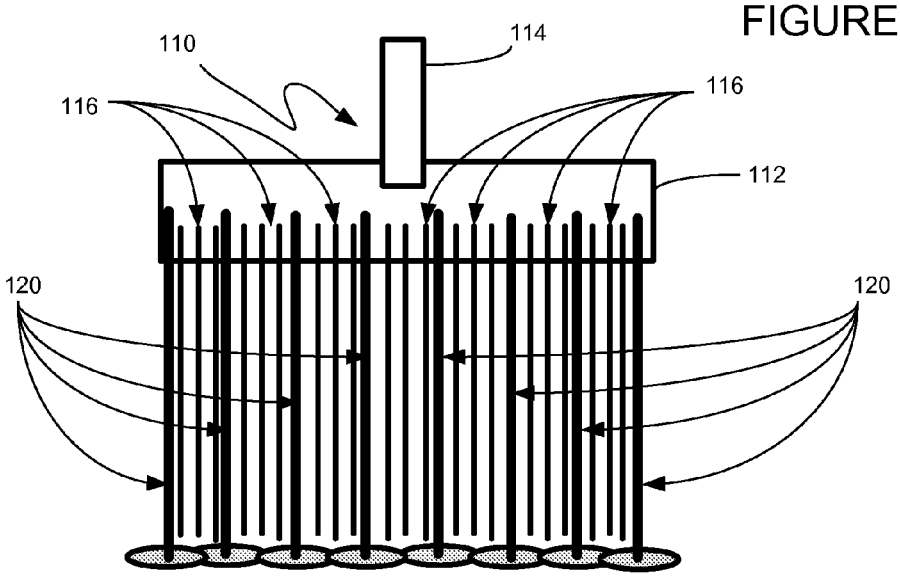
Figure 15:
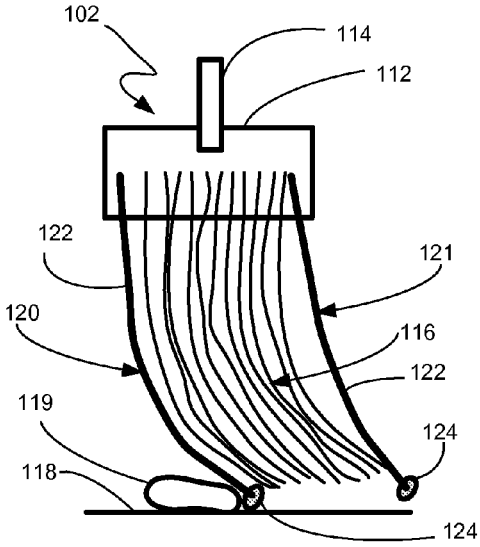
FIGS. 15 through 18 are schematics showing the brooms in FIGS. 4 and 11, 12 and 14A sweeping material.

In an another embodiment, as shown in FIG. 4, the aggressive bristles 120 and 126 can be located along the front and/or rear of the broom head 114 to enhance the sweeping efficiency of the broom 102. One of ordinary skill in the art would readily recognize that the aggressive bristles 120 could be located on one or both sides of the conventional bristles 116, i.e., in front of or behind the conventional bristles 116, or interspersed among the convention bristles 116, or both. In operation, as shown in FIG. 15, as the leading primary or aggressive bristle 120 sweeps over the debris or material 119 to be swept along the surface 118, the primary bristle 120, like any conventional bristle, tends to lie down somewhat in the horizontal direction along the floor or surface 118 from the pressure of the broom 102 moving over the floor 118 and debris 119. As the leading primary bristle 120, which is preferably longer than the passive bristles 116, lays down or bends positioning the cap 124 at the end of the bristle 120 underneath the passive bristles 116, the cap 124 tends to be oriented at a angle open to the debris 119, thus allowing the cap to catch, hook or hold on to the debris 119 being swept. The passive bristles 116 tend to put pressure on the cap 124 holding the cap 124 down against the floor or ground 118 allowing it to hook, grab or catch the material 119 being swept. The trailing row of aggressive bristles 126 also tends to be oriented at an angle open to the debris.

Figure 6A:
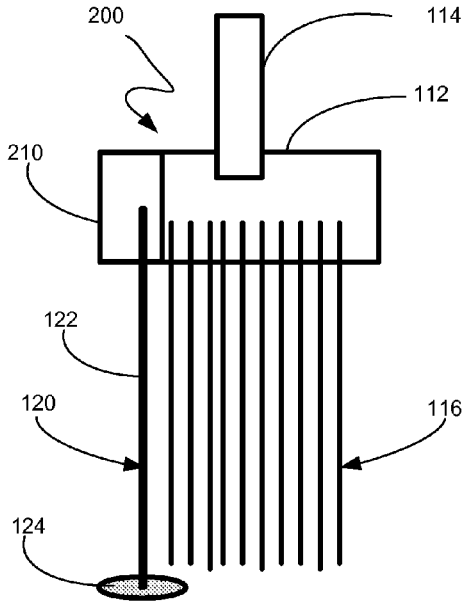
FIGS. 6A through 7B are schematics showing a broom bristle device attachable to an existing broom.
Figure 6B:
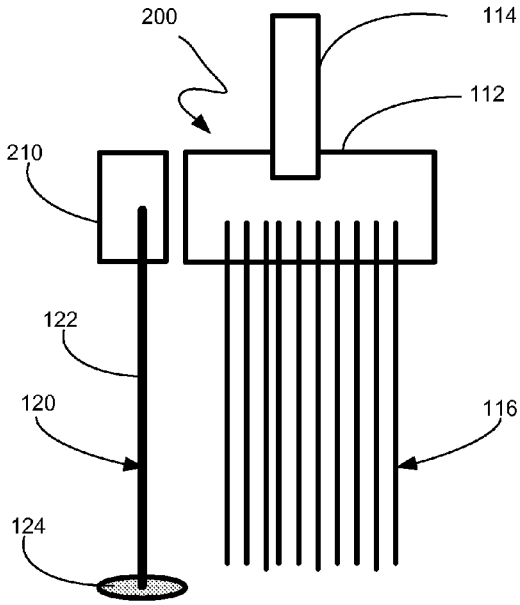
Figure 6C:
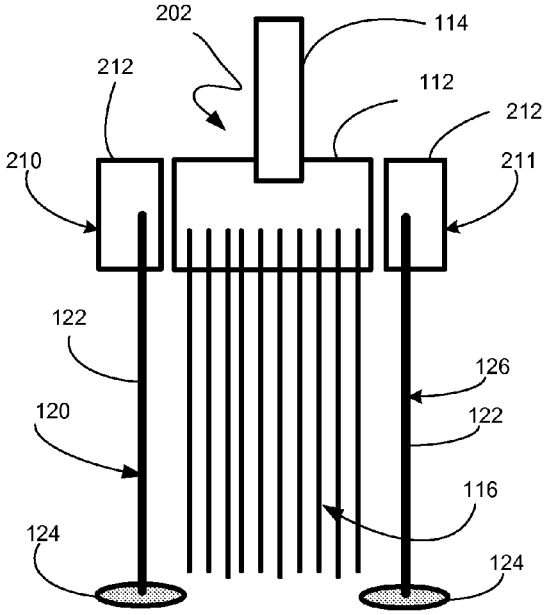

In another embodiment, as depicted in FIGS. 6A and 6B, a broom bristle device 210 may be provided that preferably comprises a base member 212 removably couplable to a head 112 of a broom 200 with bristles 116 attached thereto. The broom bristle device 210 preferably includes a plurality of bristles 120, wherein each of the plurality of bristles 120 comprises a body 122 having a first end coupled to the base member 212 and a hooking member or cap 124 coupled to or formed at a second end of the body 122. Alternatively, a second broom bristle device 211 may be provided that preferably comprises a base member 212 removably couplable to an opposing side of the head 112 of a broom 202 with bristles 116 attached thereto. Once the caps 124 become worn down, the broom bristle device 210 can be replaced.

Figure 7A:
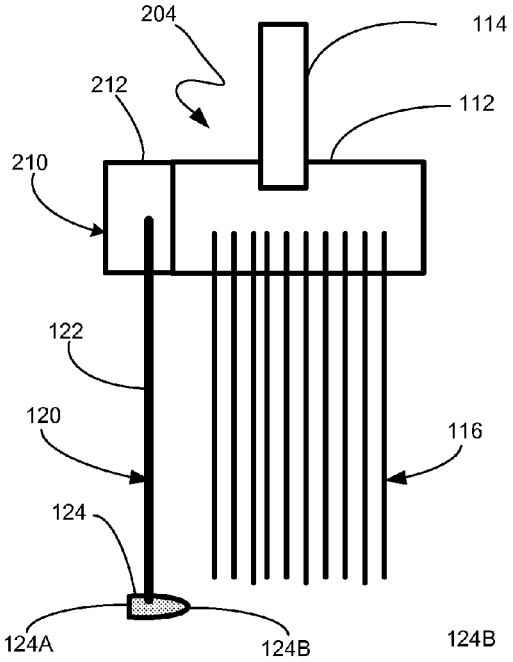
Figure 7B:
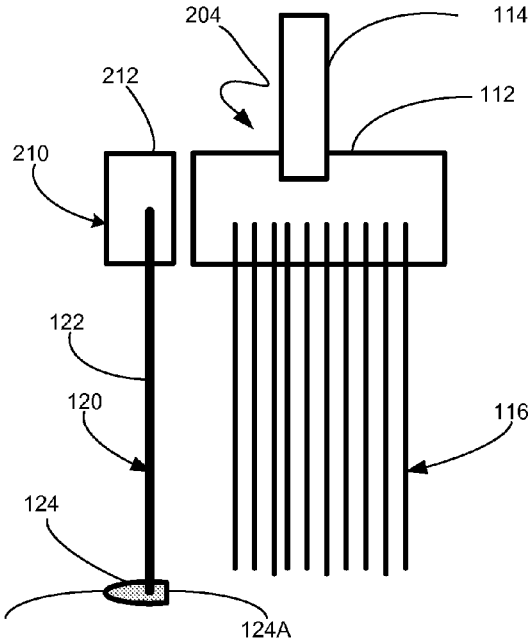

Referring to FIGS. 7A and 7B, in a preferred embodiment, the broom bristle device 210 is reversibly couplable to the head 112 of a broom 204. Once the leading side or edge 124A of the caps 124 becomes worn down, the broom bristle device 210 can be rotated, reversed or flipped, as depicted in FIG. 7B, making the trailing edge or side 124B the leading edge or side; thus doubling the life of the broom bristle device 210.

Figure 8A:
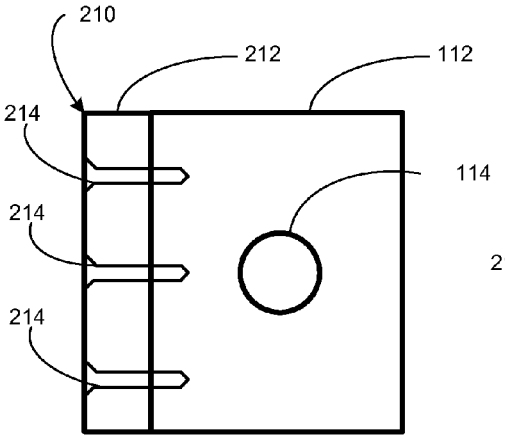
FIGS. 8A through 10C are schematics showing embodiments of different attachment means.
Figure 8B:
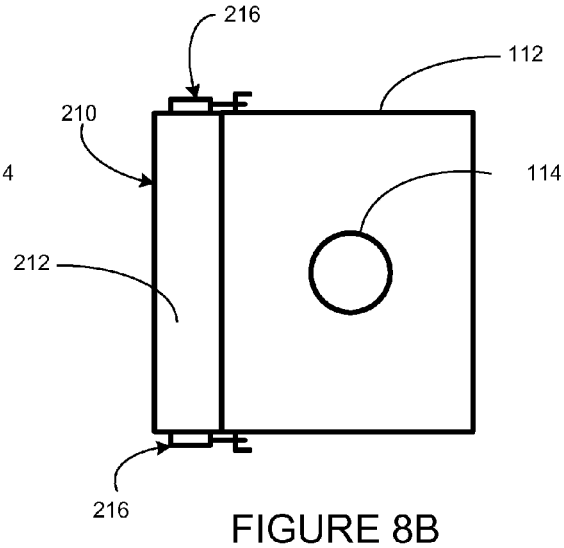
Figure 9A:
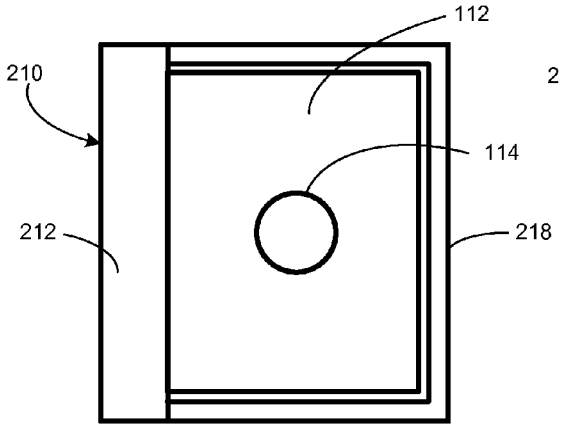
Figure 9B:
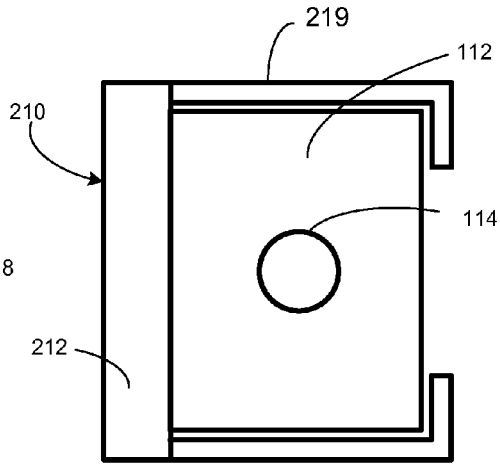

As shown in FIGS. 8A and 8B, the broom bristle device 210 can be attached to the head 112 of a broom using fasteners 214, buckles or clasps 216 with associated catch and locking members coupled to the body 212 of the broom bristle device 210 and the head 112 of the broom, and the like. Referring to FIGS. 9A and 9B, the broom bristle device 210 can include a full collar 218 or partial collar 219 extending from the body 212 of the broom bristle device 210 and slidably received over the head 112 of a broom.

Figure 10A:
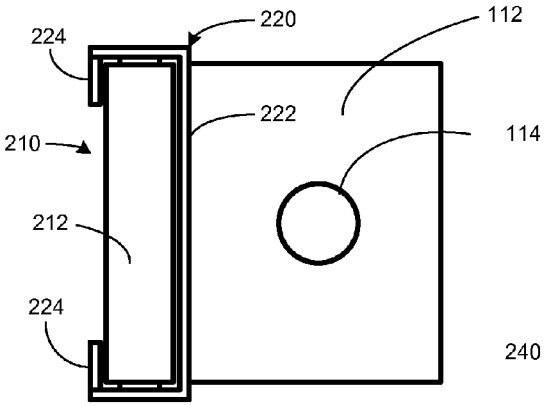
Figure 10B:
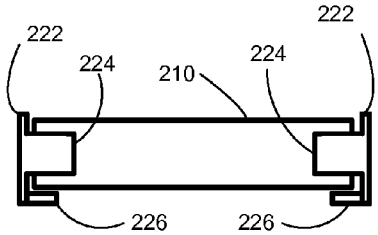
Figure 10C:
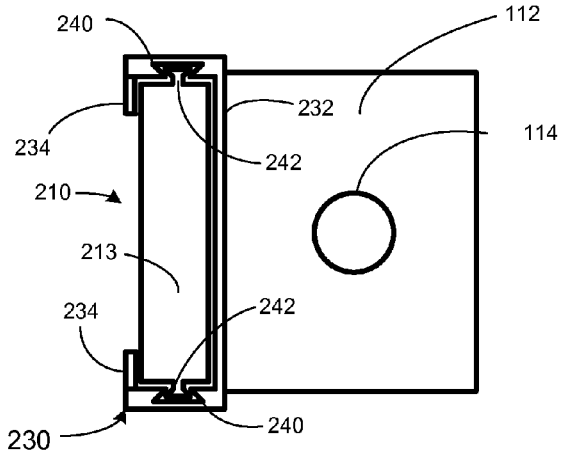

In an alternative embodiment, as depicted in FIGS. 10A, 10B and 10C, the broom bristle device 210 includes an adapter or holder 220 attached to the head 112 of a broom in a manner discussed in regard to FIGS. 8A through 9B using fasteners, buckles, clasps, collars and the like. As shown in FIGS. 10A and 10B, the holder 220 includes a body 222 with retaining arms or tabs 224 extending about and removeably receiving the body 212 of the broom bristle device 210. A pair of tabs or stops 226 is provided to retain the body 212 in the holder 220. Alternatively, the body 232 of a holder 230 includes a pair of slots or keyways 240 cut into the arms 234 of the body 232 to slidably receive a pair of keys or tabs 242 extending from a body 213 of the broom bristle device 210.

Figure 11:
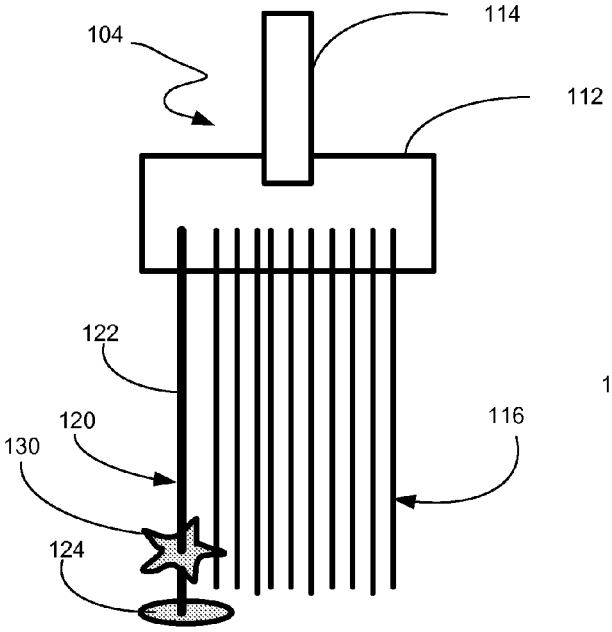
FIGS. 11, 12 and 14A are schematic side views of alternative embodiments of a broom.
Figure 16:
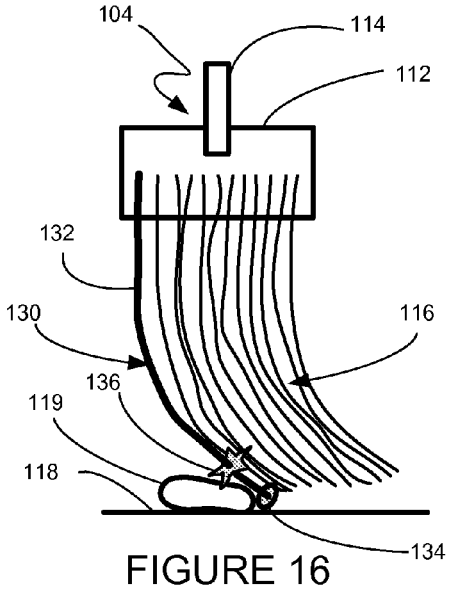

Alternative embodiments of the broom with the aggressive bristles 120 that work in the same manner as described above are depicted in FIGS. 11 through 14B and 16 through 21. Turning to FIGS. 11 and 16, an alternative embodiment of the broom 104 is shown to include an additional cap 130 along the active sweeping area of the body 122 of the aggressive bristle 120 above the primary cap 124. As depicted, the additional cap 130 is star shaped. However, one of skill in the art would readily recognize that the additional cap 130 and the primary cap 124 can be any shape and can be the same or different shapes and made of the same or different materials than that of the bristle aggressive bristle 120. Alternatively, the additional cap 130 may be a larger, more aggressive cap or hooking member that is retained on the bristle 120 by the primary cap 124 (see, e.g., disk 125 in FIG. 5D).

Figure 12:
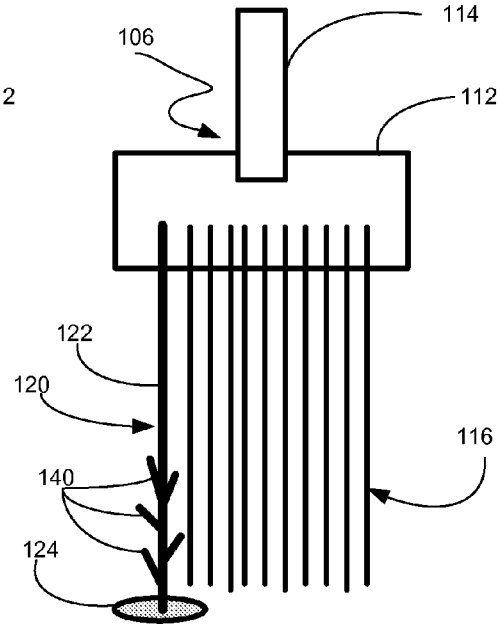
Figure 17:
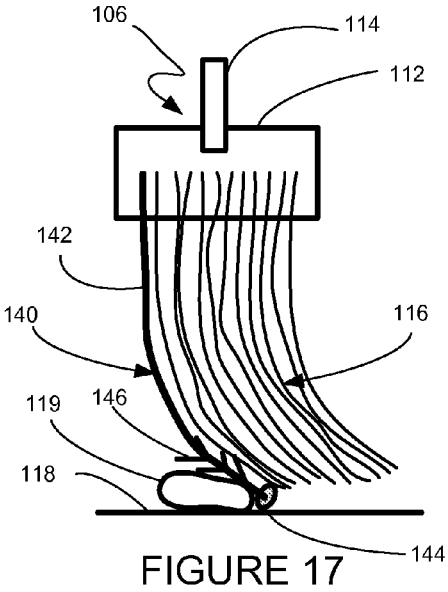

FIGS. 12 and 17 provide another alternative embodiment of the broom 106 wherein the aggressive bristle 120 includes barbs 140 extending from the body 122 of the bristle 120 above the cap 124 in the active sweep area of the bristle 120. Alternatively, the aggressive bristle 120 could include a plurality of barbs 140 and no cap 124.

Figure 13A:
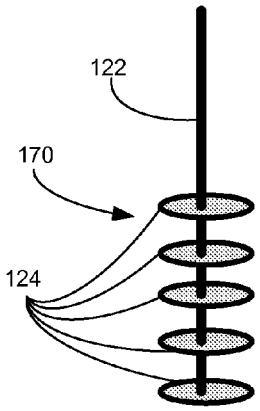
FIGS. 13A, 13B and 14B are schematic side view of alternative embodiments of an aggressive bristle.
Figure 13B:
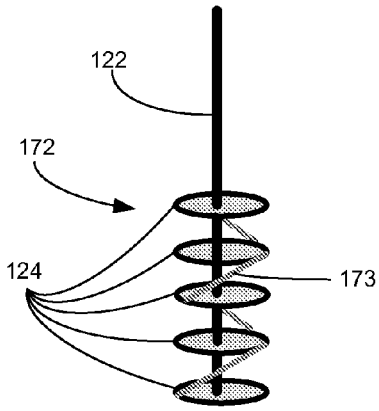

As shown if FIG. 13A, an alternative embodiment of an aggressive bristle 170 is shown to include a multiple caps or disks 124 positioned along the body 122 of the bristle 170 for additional hooking or sweeping power. The body 122 and cap 124 at the base of the bristle 170 can be made out of a unitary piece of flexible plastic. The additional discs can be made of plastic, metal and the like, and can be formed in different shapes and sizes, and positioned throughout the broom. An alternative embodiment bristle 172 is shown in FIG. 13B to include multiple caps or disks 124 positioned along the body 122 of the bristle 172 and tethered together with a tether 173.

Figure 14A:
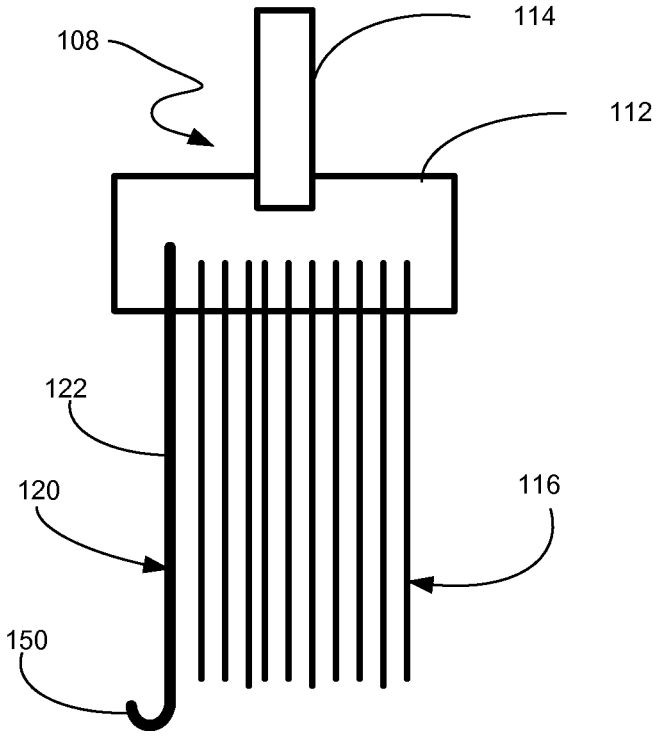
Figure 14B:
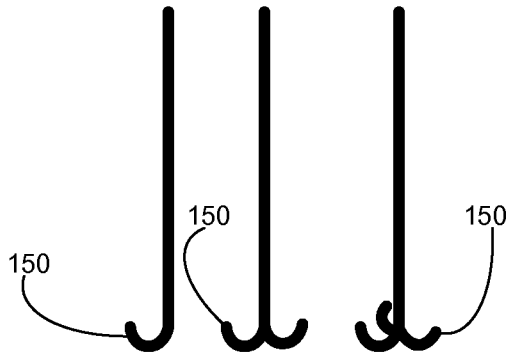
Figure 18:
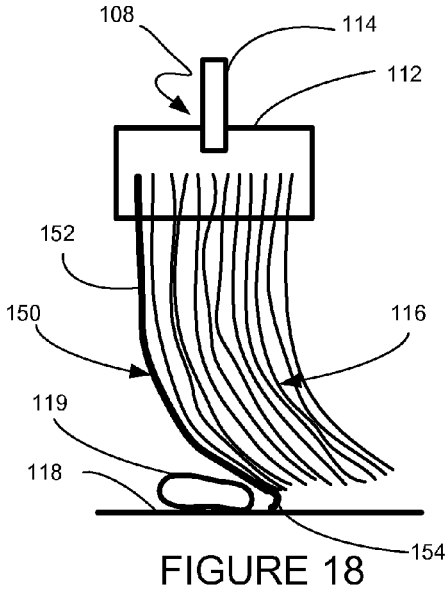

Turning to FIGS. 14A, 14B and 18, the aggressive bristle 120 is depicted to include a hook or a plurality of hooks 150 (see FIG. 7B). The hook 150, as depicted, is "J" or "U" shaped, but could also be "L" or cantilever shaped, or "V" shaped. In this embodiment, the body 122 and hook 150 is preferably made stiff enough to resist twisting when pressured against the ground or floor 118 which would result in flattening out the hook 150—the larger the size of the hook 150 the larger the diameter of the bristle 120 should be to prevent twisting of the hook 150 as it comes in contact with the object 119 being swept.

The cap 124 of the preferred embodiment tends not to fold over or depend on the strength of the body 122 of the bristle 120 to sweep the material being swept and, if in a rounded or oval shape, tends to align in the proper position to hook the material being swept.

Other advantages of the aggressive bristle 120 is that it can be combined within a broom to make it even more aggressive in terms of sweeping power by positioning the aggressive bristles in different bristle locations throughout the bristles.

Figure 19A:
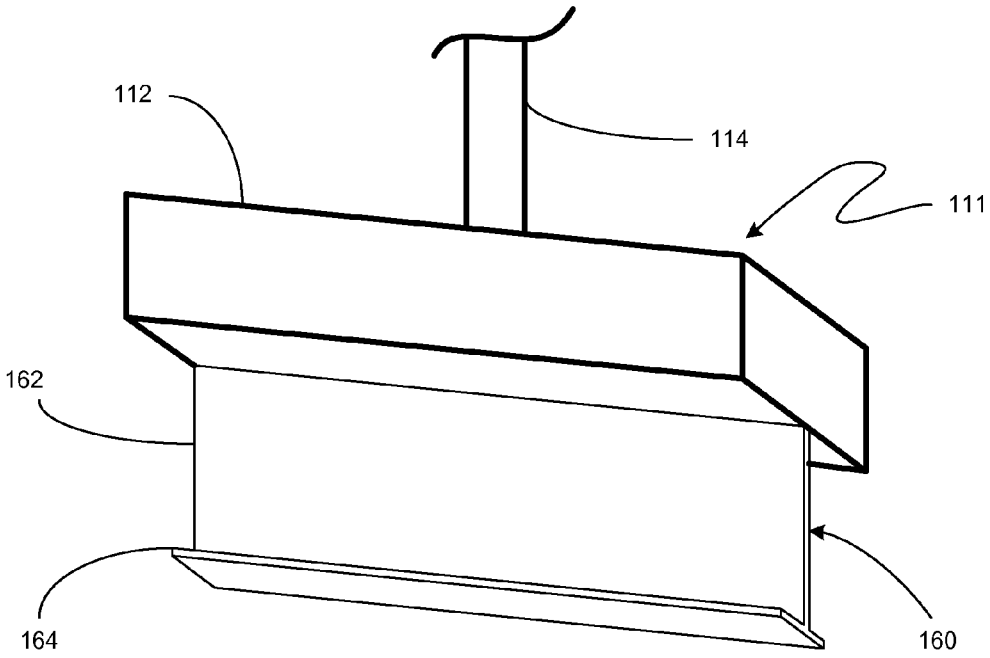
FIGS. 19A through 19B are schematic perspective and side views of alternative embodiments of a broom.
Figure 19B:
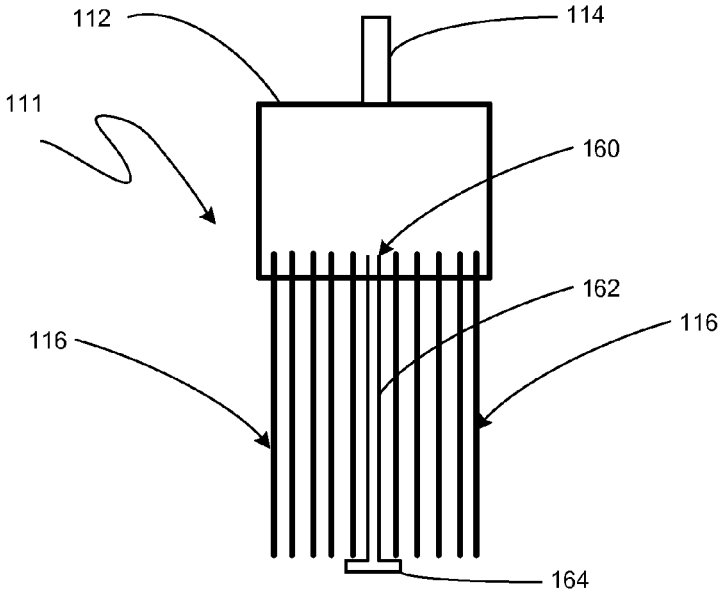
Figure 20A:
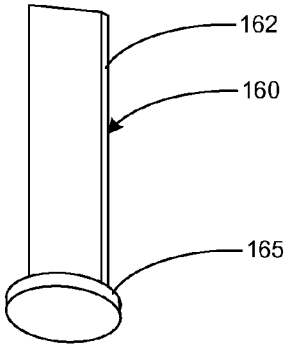
FIGS. 20A and 20B are partial perspective views of embodiments of the bristle and hooking member of FIGS. 19A and 19B.
Figure 20B:
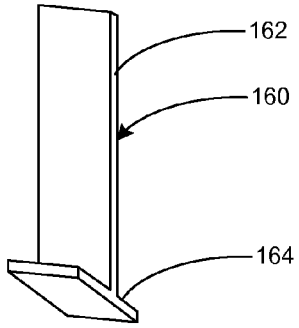
Figure 21:
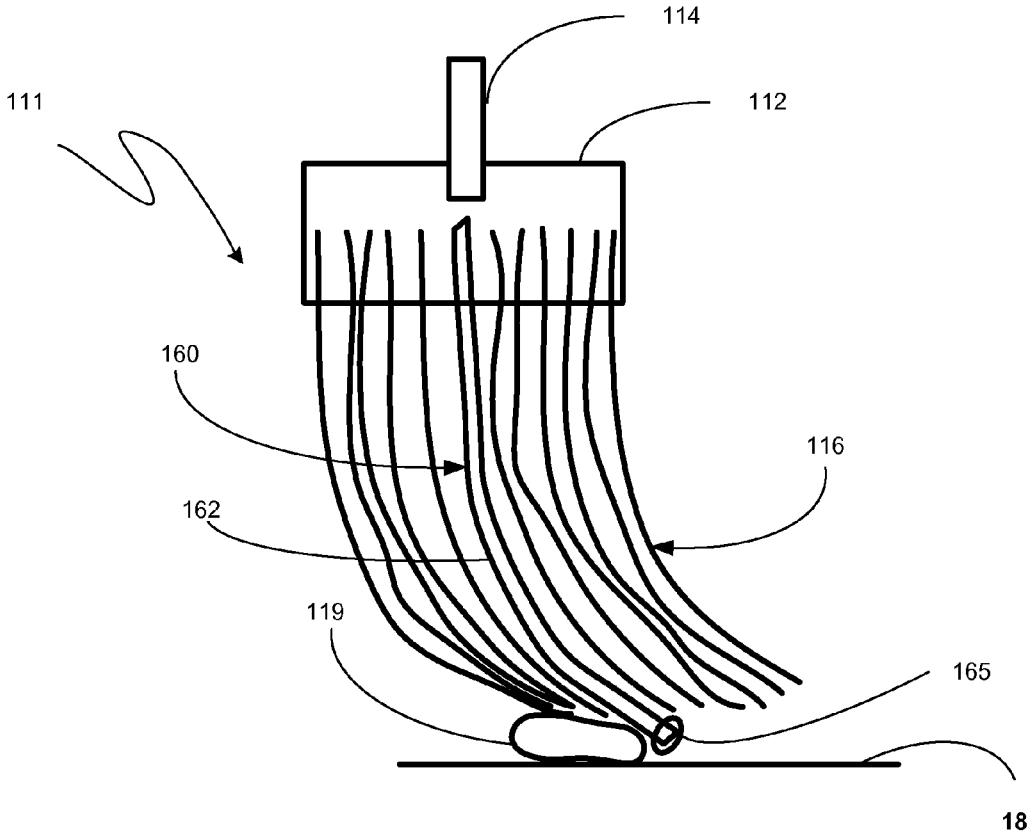
FIG. 21 is a schematic showing a broom with a bristle 19A sweeping material.

Turning to FIGS. 19A, 19B and 21, another embodiment includes a squeegee type bristle 160 having a flat body 162 attachable at a first end to the head 112 of a broom 111 and at a second end to a cross-member 164, wherein the squeegee type bristle 160 has a T-shaped profile. In a preferred embodiment, the squeegee type bristle 160 would comprise a plurality of bristles 160 in contrast to a single bristle 160 shown in FIG. 19A. Although shown positioned in the middle of all the bristles 116, the squeegee type bristle 160 may be located in front of, behind or dispersed amongst the bristles 116. As shown in FIGS. 20A and 20B, the squeegee type bristle 160 may include a square or rectangular 164, round or oval disc 165, or the like, attached to the flat body 162 of the bristle.

Figure 22:
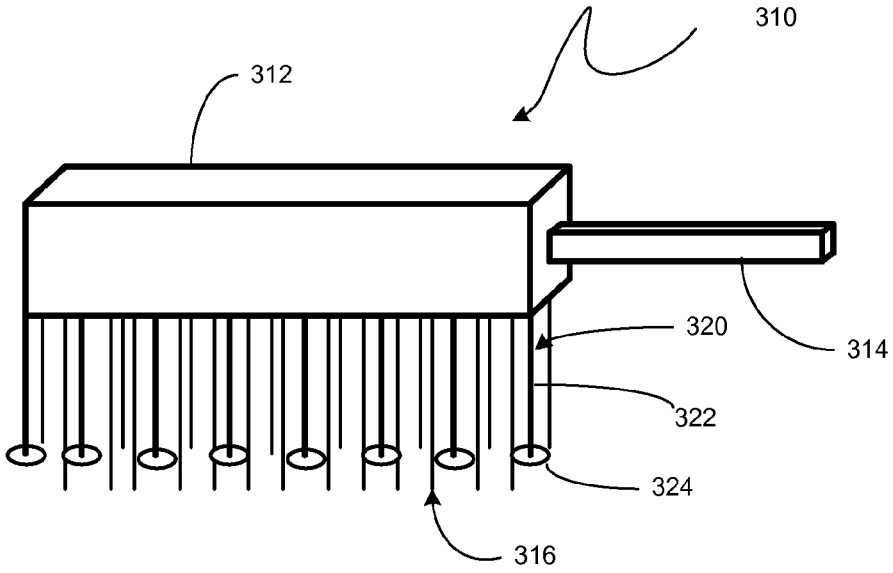
FIG. 22 is a schematic perspective view showing a toothbrush embodiment.

Turning to FIG. 22, a toothbrush 310, as depicted, includes aggressive bristles 320 as well as conventional bristles 316 coupled to a toothbrush head 312 of the toothbrush 310. The aggressive bristles 320 having a body 322 coupled to the head 312 at one end and to a cap 324 at the other end.

Figure 23:
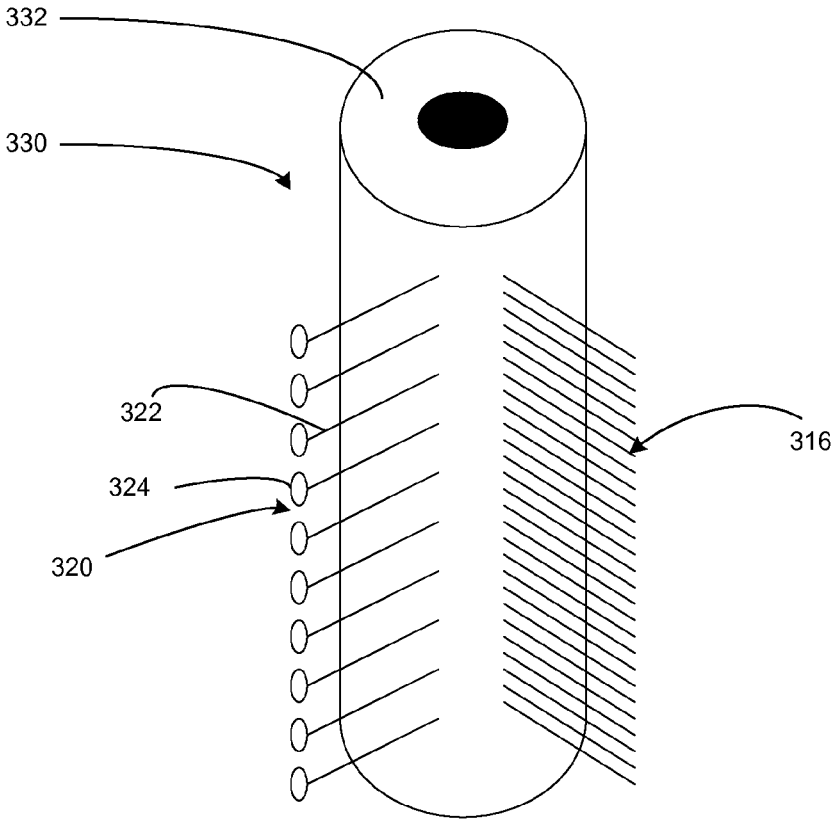
FIG. 23 is a schematic perspective view showing a carpet sweeper brush embodiment.

Referring to FIG. 23, a carpet sweeper brush 330 is depicted with a row of aggressive bristles 320 and a row of conventional bristles 316 coupled to a cylindrical brush element 332. The aggressive bristles 320 having a body 322 coupled to a cylindrical brush element 332 at a first end and to a cap 324 at a second end. Although depicted in separate rows, the aggressive bristles 320 can be interspersed among the conventional bristles 316.

Figure 24A:
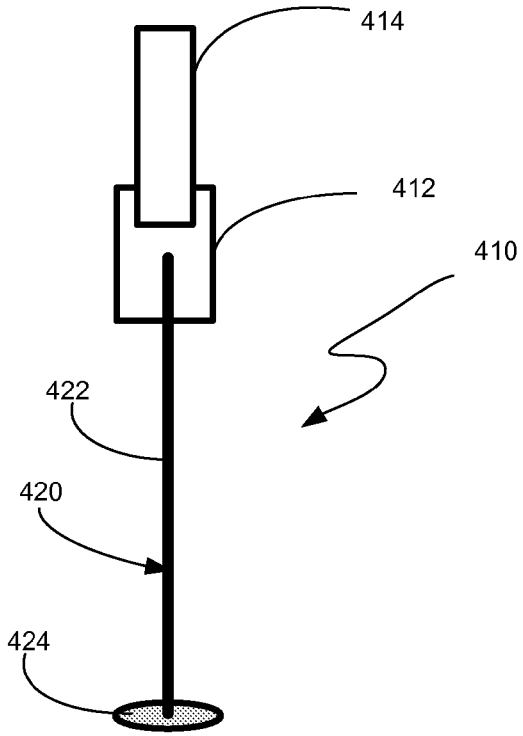
FIGS. 24A through 24B are schematic side and front views of a rake embodiment.
Figure 24B:
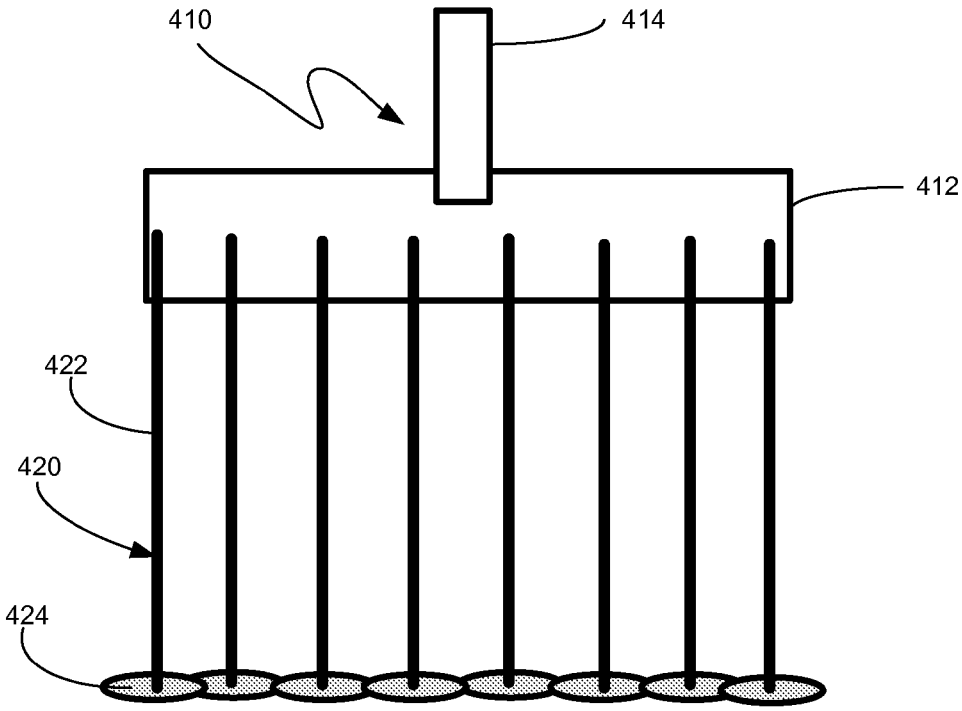
Figure 25A:
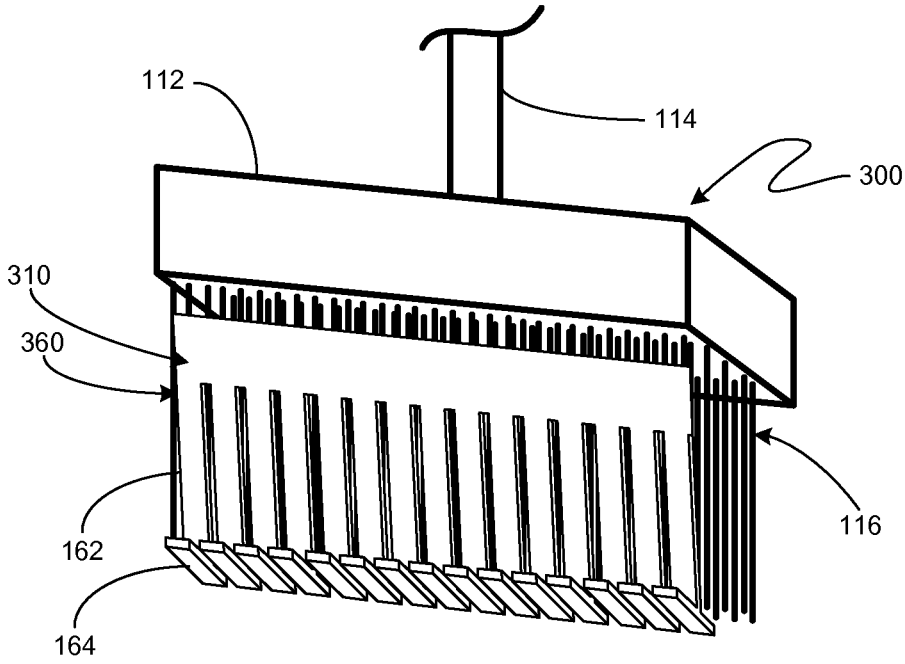
FIGS. 25A through 27B are schematic perspective, side and front views of a bristle device couplable to a broom.
Figure 25B:
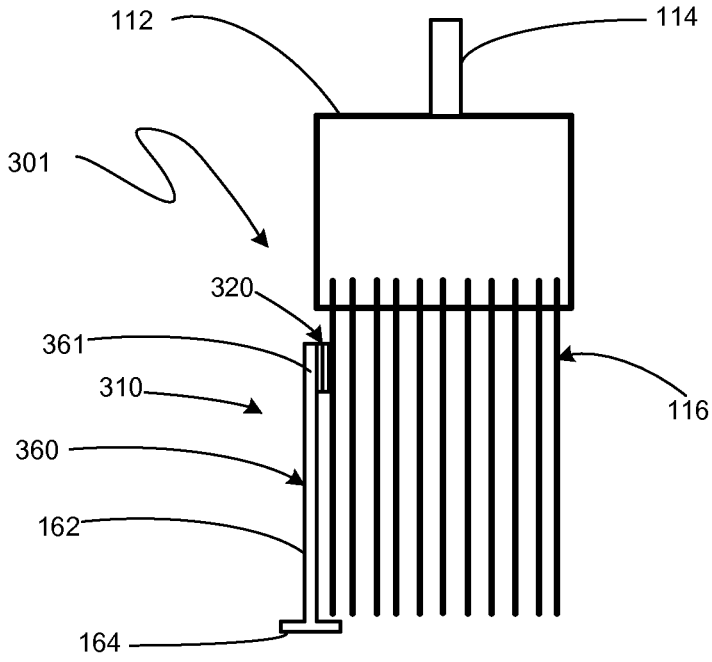
Figure 26A:
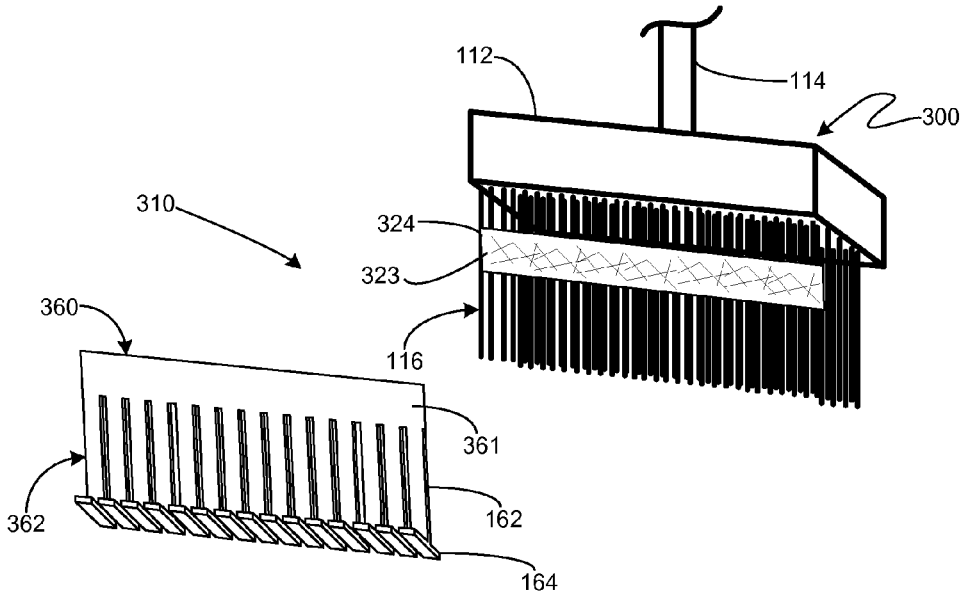
Figure 26B:
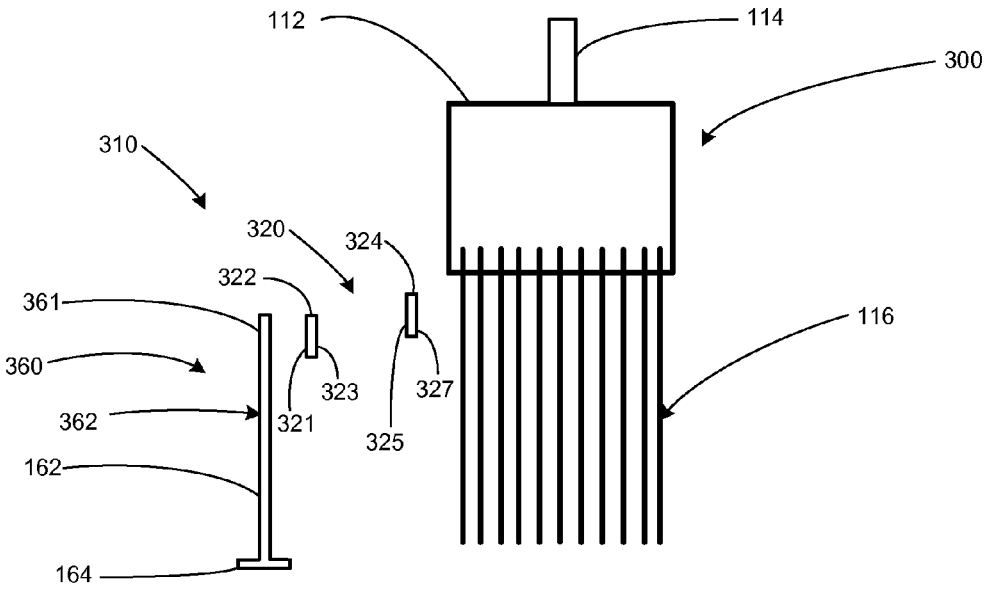

Another embodiment is provided in FIGS. 24A and 24B, which depict a rake 410 having a handle 414 extending from a head 412 of the rake 410. A plurality of hooking members 420 are provided, each having a stiff body 422, preferably formed from wire or the like, coupled at a first end to the head 412 of the rake 410 and at a second end to a hooking member 424.

In another embodiment, as depicted in FIGS. 25A, 25B, 26A and 26B, a bristle device 310 may be provided that preferably comprises a coupling system 320 for releasably mounting a bristle member 360 to a broom 300 which comprises a handle 114 attached to a broom head 112 and conventional or passive bristles 116 attached at a first end of the bristles 116 to the broom head 112. The bristle member 360, which includes an elongate base member 361 and a plurality of bristles 362 extending from and integrally formed with the base 361, can be mounted on the front and/or rear of the broom 300 attaching to the head 112 or the bristles 116 of the broom 300. Each of the plurality of bristles 362 is an aggressive bristle that comprises a body 162 having a first end coupled to the base member 361 and a hooking member 164 coupled to or formed at a second end of the body 162. When the bristle member 360 is mounted on the broom 300, the hooking member 164 of the bristles 362 is preferably positioned adjacent to, e.g., just beyond or parallel to, the free ends of the passive bristles 116. The bristles 362 of the bristle member 360 can be longer than the passive bristles 116 or be positioned to be longer than the passive bristles 116 when the bristle member 360 is attached to the passive bristles 116 or the head 112 of the broom 300. The body 162 of the bristle is preferably flat and the hooking or cross-member 164 forms a T-shape profile with the body 162. Alternatively, the hooking or cross-member 164 forms an L-shape profile with the body 162.

The coupling system 320 preferably comprises a fastener, such as, e.g., a hook-and-loop type fastener. The hook-and-loop type fastener is preferably in the form of a re-closable self-stick cloth tape strips with hook or loop fastener members on one face of each cloth strip and an adhesive on the other face of the cloth strip. A first half of the hook-and-loop fastener 320 functions as a mounting base 324 couplable to the head 112 or, as depicted, to the bristles 116 of the broom 300. The mounting base 324 preferably has an adhesive backing applied to a first or broom side 327 of the mounting base 324. The second or coupling side 325 of the mounting base 324 comprises the hook or loop member half of the fastener 320. A second half of the hook-and-loop fastener 320 functions as a coupling member 322. The coupling member 322 preferably has an adhesive backing applied to a first or bristle member side 321 of the coupling member 322. The second or coupling side 323 of the coupling member 322 comprises the hook or loop member half of the fastener 320. In operation, the mounting base 324 of the coupling system 320 is affixed to the bristles 116 or head 112 of the broom 300 and the coupling member 322, which is affixed to the base 361 of the bristle member 360, is releasably coupled to the mounting base 324 to enable the bristle member 360 to be releasably coupled to a broom 300. Once the bristles 362 of the bristle member 360 wear out or down, the bristle member 360 can be removed from the broom 300 by disengaging the coupling member 322 from the mounting base 324 of the coupling system 320 and replaced with a new bristle member 360 by coupling the coupling member 322 of the new bristle member 360 to the mounting base 324 already coupled to the bristles 116 or head 112 of the broom 300.

Figure 27A:
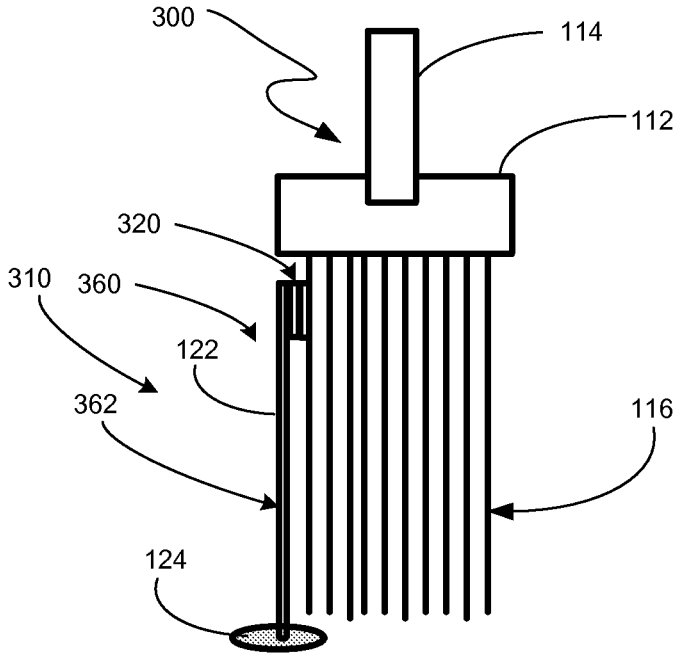
Figure 27B:
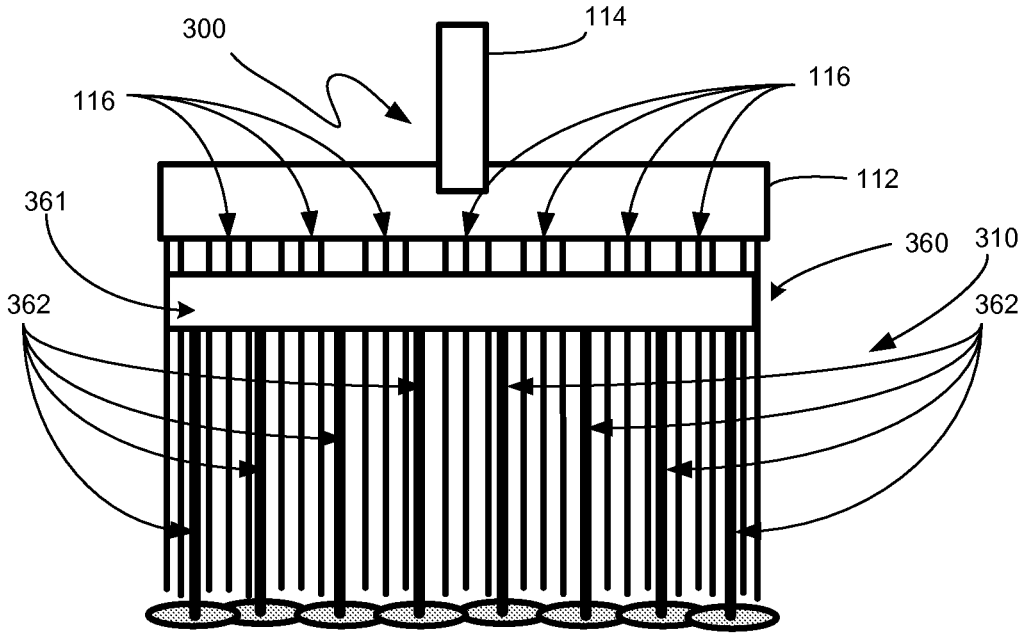

Alternatively, as depicted in FIGS. 27A and 27B, the bristle member 360 of the bristle device 310 preferably includes a plurality of bristles 362, wherein each of the plurality of bristles 362 comprises a body 122 having a first end coupled to a base member 361 and a hooking member or cap 124 coupled to or formed at a second end of the body 122.

In a further embodiment, a bristle device kit is provided comprising a mounting base 324, which is couplable to the bristles or head of a broom, and a plurality or N bristle members 360 each coupled to a coupling member 322 which is releasably couplable to the mounting base 324.

In the foregoing specification, the invention has been described with reference to specific embodiments thereof. It will, however, be evident that various modifications and changes may be made thereto without departing from the broader spirit and scope of the invention. For example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed is:

1. A broom bristle device comprising a flexible mounting base configured to attach to both a head of a broom and bristles of a broom, wherein the mounting base is coupled to one of the head and bristles of the broom, and a bristle member releasably couplable to the mounting base, the bristle member comprising an elongate base member and a plurality of bristles extending from the base member, wherein each of the plurality of bristles comprises a body having a first end coupled to the base member and a hooking member coupled to a second end of the body to form a cap on the second end of the body with the second end of the body terminating into the cap, the hooking member forming a sweeping barrier to debris on a surface to be swept as the plurality of bristles of the bristle member and the bristles of a broom to which a bristle member is attached are swept across the surface.

2. The broom bristle device of claim 1, further comprising a coupling member coupled to the base member of the bristle member, wherein the coupling member releasably couples to the mounting base.

3. The broom bristle device of claim 2, wherein the coupling member and mounting base comprise the hook and loop members of a hook-and-loop fastener.

4. The broom bristle device of claim 3, wherein the coupling member and mounting base each include an adhesive backing to couple the coupling member to the base of the bristle member and the mounting base to a head or bristles of a broom.

5. The broom bristle device of claim 1 wherein the cap is positioned at about a 90 degree angle to the body.

6. The broom bristle device of claim 1 wherein the cap and body are integrally formed.

7. The broom bristle device of claim 1 wherein the cap is oval or circularly shaped.

8. The broom bristle device of claim 1 wherein the hooking member forms a T-shape profile with the body.

9. The broom bristle device of claim 1 wherein the hooking member forms a L-shape profile with the body.

10. The broom bristle device of claim 1 wherein the plurality of bristles of the bristle member are longer than the bristles of a broom to which the broom bristle device is attached or the hooking members of the plurality bristles are positioned beyond a free end of the bristles of a broom to which the broom bristle device is attached.

11. A broom bristle device kit comprising a flexible mounting base configured to attach to both a head of a broom and bristles of a broom, and a plurality of bristle members each being releasably couplable to the mounting base, each of the plurality of bristle members comprising an elongate base member and a plurality of bristles extending from the base member, wherein each of the plurality of bristles comprises a body having a first end coupled to the base member and a hooking member coupled to a second end of the body to form a cap on the second end of the body with the second end of the body terminating into the cap, the hooking member forming a sweeping barrier to debris on a surface to be swept as the plurality of bristles of the bristle member and the bristles of a broom to which a bristle member is attached are swept across the surface.

12. The kit of claim 11, further comprising a plurality of coupling members each separately coupled to the base member of a separate bristle member of the plurality of bristle members, wherein the coupling member releasably couples to the mounting base.

13. The kit of claim 12, wherein a coupling member of the plurality of coupling members and the mounting base comprise the hook and loop members of a hook-and-loop fastener.

14. The kit of claim 13, wherein each of plurality of coupling members and the mounting base include an adhesive backing to couple the coupling member to the base of the bristle member and the mounting base to a head or bristles of a broom.

15. The kit of claim 11 wherein the cap is positioned at about a 90 degree angle to the body.

16. The kit of claim 11 wherein the cap and body are integrally formed.

17. The kit of claim 11 wherein the cap is oval or circularly shaped.

18. The kit of claim 11 wherein the hooking member forms a T-shape profile with the body.

19. The kit of claim 11 wherein the hooking member forms a L-shape profile with the body.

20. The kit of claim 11 wherein the plurality of bristles of the bristle member are longer than the bristles of a broom to which the broom bristle device is attached or the hooking members of the plurality bristles are positioned beyond a free end of the bristles of a broom to which the broom bristle device is attached.

* * * * *